US006027321A

United States Patent [19]

Shim et al.

[11] Patent Number: 6,027,321

[45] Date of Patent: Feb. 22, 2000

[54] SCROLL-TYPE COMPRESSOR HAVING AN AXIALLY DISPLACEABLE SCROLL PLATE

[75] Inventors: Jae Kil Shim, Kyung Ki-Do; Hiun Won, Seoul; Wan Pyo Park; Man Hee Lee, both of Chungnam, all of Rep. of Korea

[73] Assignee: Kyungwon-Century Co. Ltd., Seoul, Rep. of Korea

[21] Appl. No.: 08/797,253

[22] Filed: Feb. 7, 1997

[30] Foreign Application Priority Data

Feb. 9, 1996 [KR] Rep. of Korea ..... 96-3223
Mar. 27, 1996 [KR] Rep. of Korea ..... 96-8659

[51] Int. Cl.[7] ..... F04C 18/04

[52] U.S. Cl. ..... 418/1; 418/14; 418/55.1; 418/55.4; 418/55.5; 418/57; 418/270

[58] Field of Search ..... 418/1, 14, 55.5, 418/57

[56] References Cited

U.S. PATENT DOCUMENTS

| | | | |
|---|---|---|---|
| 3,600,114 | 8/1971 | Dvorak et al. | 418/55.5 |
| 3,874,827 | 4/1975 | Young | 418/55.5 |
| 3,884,599 | 5/1975 | Young et al. | 418/55.5 |
| 3,924,977 | 12/1975 | McCullough | 418/55.5 |
| 4,216,661 | 8/1980 | Tojo et al. | 62/505 |
| 4,475,360 | 10/1984 | Suefuji et al. | 62/324 |
| 4,496,296 | 1/1985 | Arai et al. | 418/55.5 |
| 4,505,651 | 3/1985 | Terauchi et al. | 417/440 |
| 4,585,403 | 4/1986 | Inaba et al. | 418/55.5 |
| 4,764,096 | 8/1988 | Sawai et al. | 418/55.5 |
| 4,767,293 | 8/1988 | Caillat et al. | 418/55.5 |
| 4,818,195 | 4/1989 | Murayama et al. | 418/55.1 |
| 4,877,382 | 10/1989 | Caillat et al. | 418/55.5 |
| 5,141,421 | 8/1992 | Bush et al. | 418/55.3 |
| 5,156,539 | 10/1992 | Anderson et al. | 418/55.4 |
| 5,192,202 | 3/1993 | Lee | 418/55.5 |
| 5,458,471 | 10/1995 | Ni | 418/55.5 |
| 5,540,572 | 7/1996 | Park et al. | 418/55.5 |
| 5,707,210 | 1/1998 | Ramsey et al. | 418/55.5 |

FOREIGN PATENT DOCUMENTS

| | | | |
|---|---|---|---|
| 4128580 | 4/1992 | Japan | 418/55.5 |
| 6-26471 | 2/1994 | Japan | 418/55.5 |

*Primary Examiner*—John J. Vrablik
*Attorney, Agent, or Firm*—Finnegan, Henderson, Farabow, Garrett & Dunner, L.L.P.

[57] ABSTRACT

A scroll-type compressor has a scroll plate that is prevented from moving radially or rotating but may be axially displaced. The configuration includes a key and key way configuration and springs to axially bias one scroll plate away from the other scroll plate. The major components of the compressor assembly can be axially assembled.

18 Claims, 16 Drawing Sheets

SCROLL-TYPE COMPRESSOR HAVING AN AXIALLY DISPLACEABLE SCROLL PLATE

BACKGROUND OF THE INVENTION

1. Field of the Invention

This invention relates to compressors, and more particularly to a scroll-type compressor configuration that is easily assembled and improves the efficiency and other performance characteristics of scroll-type compressors.

2. Description of the Related Art

A scroll-type compressor is a high efficiency compressor used in air conditioning systems, vacuum pumps, expanders, and engines. An example of a conventional scroll-type compressor configuration is illustrated in FIGS. 1 and 2. The scroll compressor comprises a hermetic casing A', a shaft 70', a fixed scroll plate 30', orbiting scroll plate 40', and upper frame 50'. Each scroll plate 30' and 40' has a spiral shaped wrap 31' and 41', respectively. These wraps interfit to form an interior space and a series of crescent shaped pockets. A pressure equalizing passage 44' is formed in the orbiting scroll plate to interconnect the interior space with back-pressure pocket 65' of air bushing 66'.

The orbiting scroll wrap 41' is rotationally displaced 180° relative to the stationary scroll wrap 31'. An orbiting movement is imparted to the orbiting scroll 40' by an Oldham's coupling 80' fitted into an upper frame 50'. The Oldham's coupling 80' translates rotational movement, e.g., from a rotating shaft 70', to an orbiting movement. A typical orbiting scroll will orbit at about 3600 rpm. As the orbiting scroll 40' orbits around the stationary plate 30', line contacts created between the interfitted wraps form crescent shaped pockets which begin to move radially inwards towards the center of the plates. As the crescent shaped pockets move radially inwards they reduce in volume, and therefore compress the fluid contained within the pockets. A discharge port at the center of one of the plates receives high pressure from the crescent shaped pockets when they terminate at the center. By this process, low pressure fluid is introduced at the exterior perimeter of the plates and is encased within the crescent shaped pockets as the pockets begin to form. As the pockets move inwardly, the fluid pressure increases until the fluid is discharged through the discharge port.

The scroll-type compressor has many advantages over other compressors, such as reciprocating compressors. First, the continuous movement of the scroll-type compressor does not require recompression or re-expansion. Second, the continuous and smooth operation of the scroll-type compressor eliminates problems associated with the reciprocating movement of other compressors (e.g., metal fatigue is reduced), and produces about one tenth of the torque. Third, the crescent shaped pockets are paired and offset at 180° thereby reducing non-symmetrical pressures and the vibrations and noise attendant thereto. Finally, because of their efficiency, scroll-type compressors may be smaller and lighter, and require fewer parts, resulting in lower manufacturing costs.

One of the most important concerns in scroll-type compressor efficiency is the tendency of the crescent shaped pockets to leak. Leakage can occur either though the vertical line contacts formed at the orbiting and stationary scroll plate interface at the front or back end of each pocket, or at the horizontal seals formed at the tips of a wrap 36'*a* and 46'*a* and the flat surface of the opposing scroll plate 46'*b* and 36'*b*. Most fluid pressure loss is through the horizontal seals.

Therefore, efforts have focused on minimizing fluid leakage past the tips of the wraps. One way of doing so is to minimize the clearance between scroll tips and the opposing plates. However, increasing the contact pressure on the scroll plate tips will cause premature wearing of the wrap tips and decrease the service life of the scroll plate.

The opposite problem is created by the pressure increase within the interior space which tends to produce an axial force separating the scroll plates. To counteract this separating axial force, air bushings 66 have been used. These air bushings 66' have back-pressure pockets 65' which are interconnected with the interior space through pressure equalizing passages 44'. Therefore, as the pressure in the interior space increases, the counteracting pressure in the back-pressure pocket will increase accordingly, thereby improving the efficiency of the compressor. An example of a conventional scroll-type compressor having this configuration is described in U.S. Pat. No. 4,557,675 to Murayama et al.

Another conventional configuration uses a back-pressure pocket located between the "fixed" scroll plate and a partition between the high pressure outlet region of the compressor and the low pressure inlet region. In this type of configuration, the "fixed" scroll plate is actually permitted to displace axially in response to the axial pressures created by the back-pressure pocket and the pressure within the crescent-shaped pockets.

These conventional configurations possess certain drawbacks that render their manufacture difficult. Moreover, these configurations operate at less than maximum efficiency due to problems encountered during the compressor's assembly or problems that are an unavoidable consequence of the compressor design.

No matter how efficient a compressor design is in theory, its individual parts must be assembled prior to use. The more complex the design, the more likely it is that parts may be damaged or misaligned during assembly. Thus, simplicity of assembly plays an important role in reducing the costs and maintaining system integrity of compressors. Reducing the number of components and eliminating any complex assembly steps are important advances in producing an efficient and reliable scroll-type compressor.

A related problem results from the extremely low tolerances that typically are required for scroll-type compressor components. For example, in conventional configurations that permit axial movement of the fixed scroll, a stop-bolt is generally used to prevent displacement past a certain point. In order to maintain a high operating efficiency, the bolt's dimensions and threads must be very precise. The cost of machining compressor components, such as the stop-bolt, to low tolerances significantly increases the overall cost of manufacture. Moreover, assembling these components requires precise assembly techniques that are highly dependant upon the skill of the assembler. Any error or imprecision during assembly detracts from the overall efficiency of the compressor once it is in use.

In those assemblies that use bolts to rigidly fix the fixed scroll to prevent any movement, including axial displacement, problems such as mechanically or thermally induced stresses can decrease the efficiency of the compressor. These systems also maintain intimate contact between the tips and the opposing plates of the scroll plates at all times. This intimate contact requires the compressor motor to overcome high static friction and inertia during the start-up phase of the compressor operation, thereby further reducing the overall efficiency of the compressor.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention comprises a scroll-type fluid compressor having a frame with an interior surface having at least one key way formed in the interior surface. A non-orbiting scroll plate having an end plate on which a spiral shaped wrap is located is retained in the upper frame and has a slide key interfitting with the key way. An orbiting scroll plate having an end plate on which a spiral shaped wrap is located is arranged to interfit with the non-orbiting scroll plate so that the spiral shaped wraps define an interior space comprising a series of movable, crescent shaped pockets which reduce in volume as they move radially inwardly towards a center point during an orbiting cycle in which the orbiting scroll plate orbits relative to the non-orbiting scroll plate.

It is to be understood that both the foregoing general description and the following detailed description are exemplary and explanatory, and are not restrictive of the invention as claimed.

DETAILED DESCRIPTION OF THE PREFERRED EMBODIMENT

Figure 1:
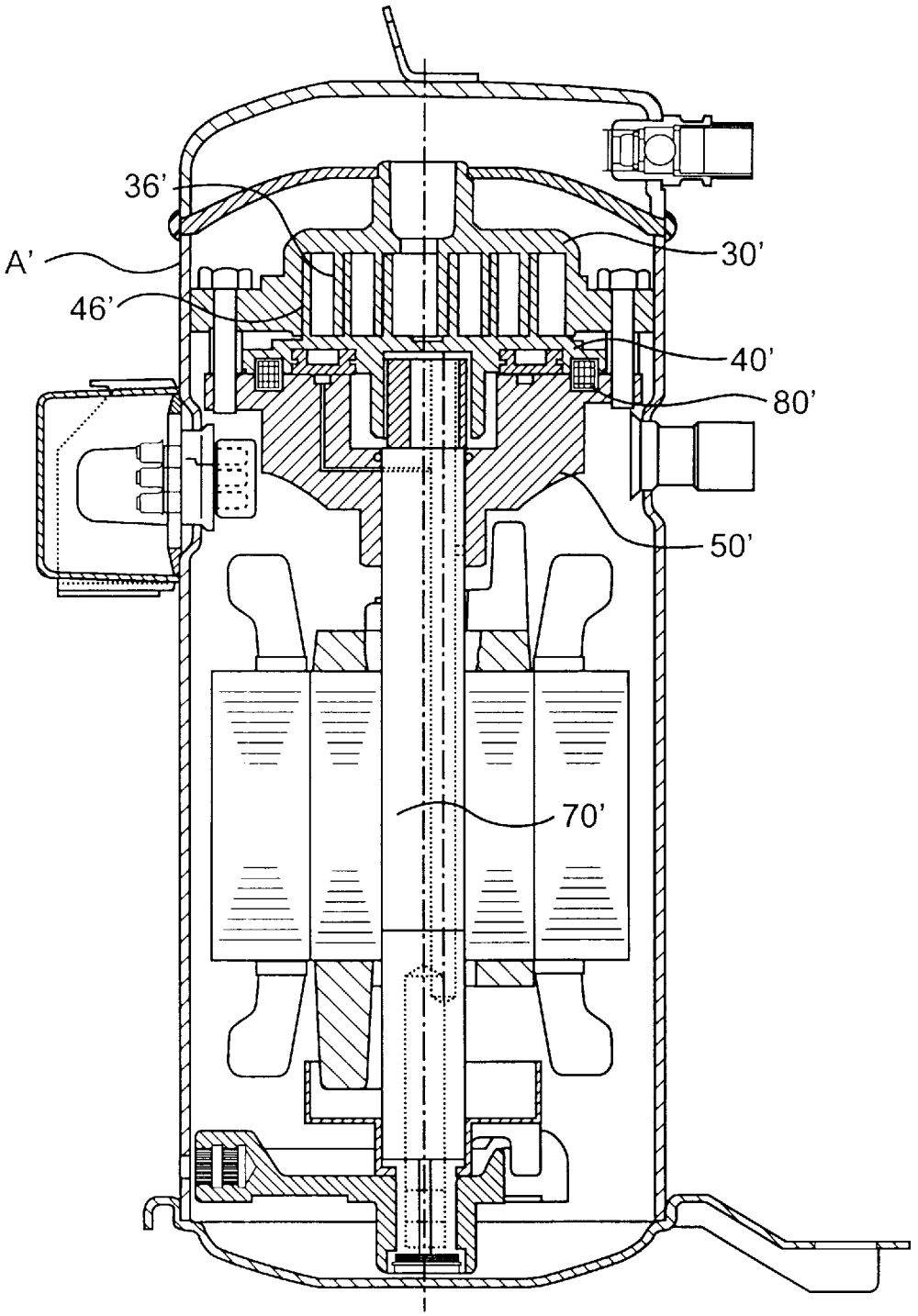
FIG. 1 PRIOR ART
FIG. 1 is a sectional view of a scroll-type fluid compressor.
Figure 2:
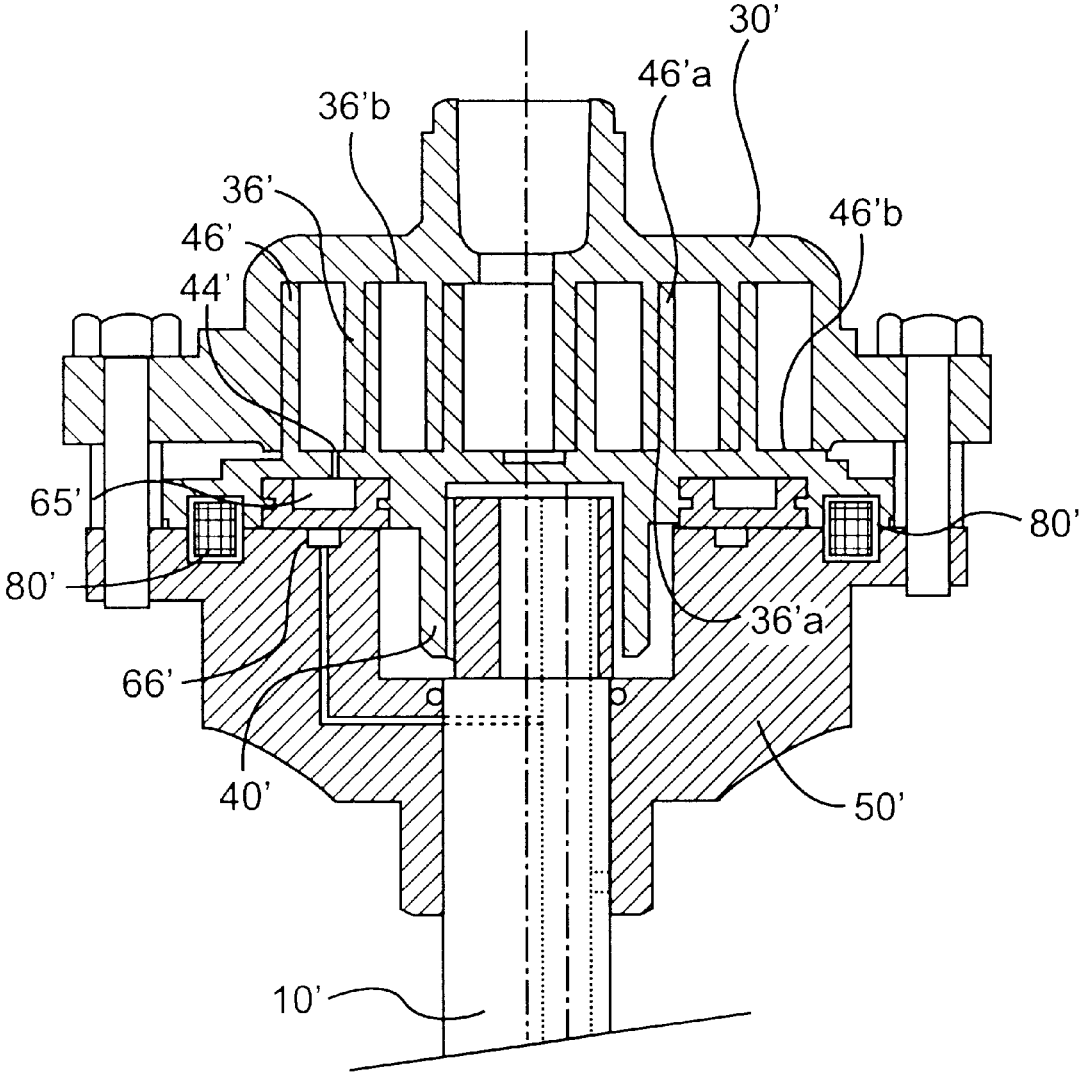
FIG. 2 PRIOR ART
FIG. 2 is a sectional view of a portion of a scroll-type fluid compressor showing two interfitting scroll plates.
Figure 3:
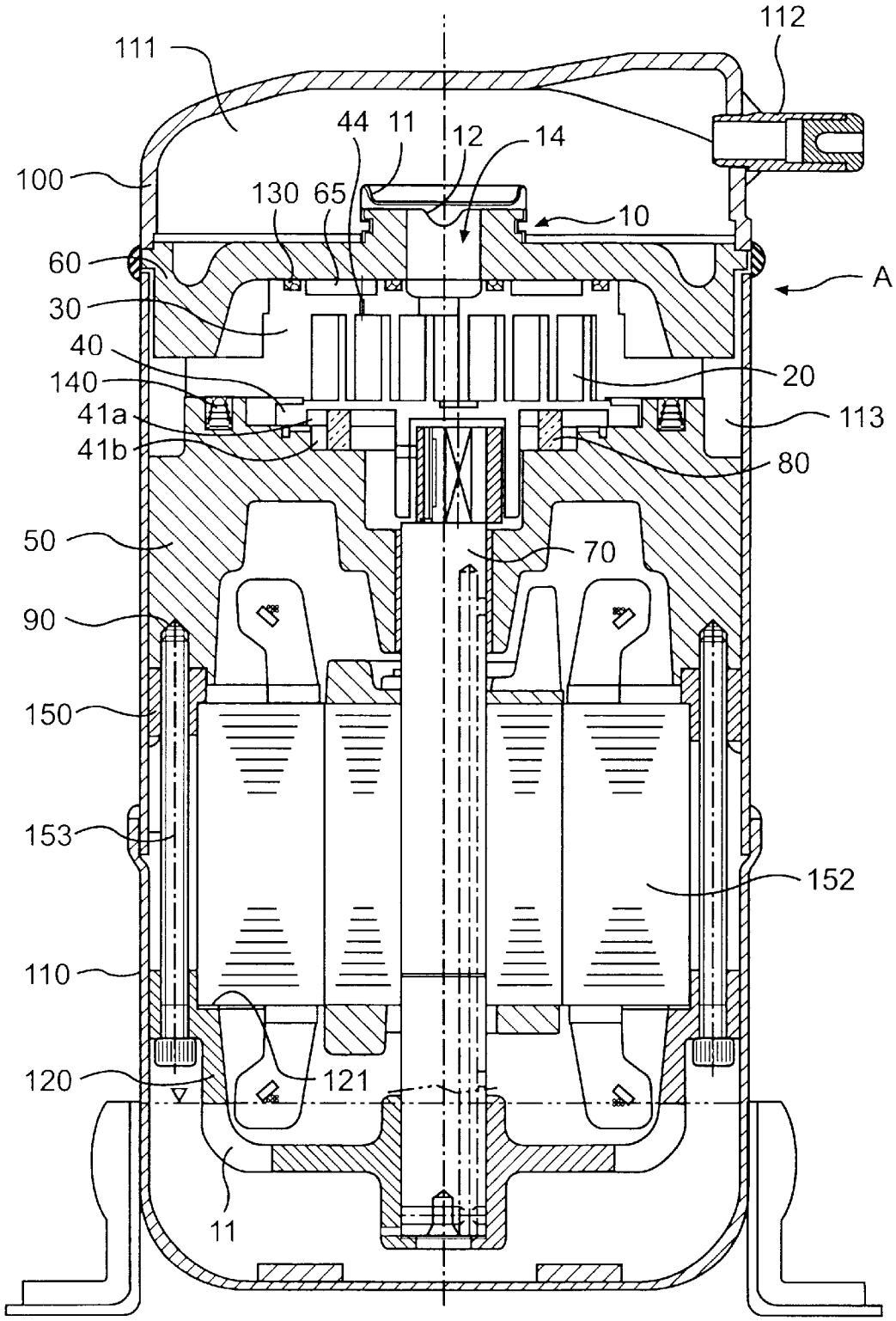
FIG. 3 illustrates a scroll-type compressor according to an embodiment of the present invention.

FIG. 3 illustrates a preferred embodiment of the present invention. The scroll compressor of FIG. 3 includes a hermetically sealed casing A being composed of an upper chamber 100, an intermediate chamber 90, and a lower chamber 110. These chambers may be welded together to form the casing.

An upper frame 50 may be located in the intermediate chamber 90. This upper frame has an interior surface (illustrated as 54 in FIG. 7) in which a non-orbiting scroll plate 30 is retained. This non-orbiting scroll plate is made up of an end plate on which a spiral shaped wrap is located.

The orbiting scroll plate 40 also has an end plate on which a spiral shaped wrap is located. The orbiting and non-orbiting scroll plates are arranged to interfit their respective spiral shaped wraps to define an interior space 20 in which a series of movable, crescent shaped pockets reduce in volume as they move radially inwardly towards a center point during an orbiting cycle in which the orbiting scroll plate orbits relative to the non-orbiting scroll plate.

The orbiting scroll plates orbits relative to the non-orbiting scroll plate by the interaction of a reduced Oldham's coupling 80 with a rotating shaft 70 driven by motor 152. A radial coupling 71 is mounted on top of the shaft to absorb tilting moments and radial inertia when the orbiting scroll 40 orbits. The Oldham's coupling has four projected slide keys—a first pair of slide keys 41 a is located on the orbiting scroll, and a second pair 41*b* is located on the upper frame 50.

A pressure partition 60 is located adjacent to the non-orbiting scroll plate 30 in a position opposite to the upper frame 50. This pressure partition separates a region of high discharge pressure 111 from a region of low suction pressure 113. As the scroll plates orbit relative to each other, the operating fluid of the compressor enters the interior space 20 from the region of low suction pressure 113 and progresses through the interior space in crescent shaped pockets that reduce in volume until they discharge the high-pressure fluid at the central discharge port 14. The fluid then flows to the region of high discharge pressure 111 through check valve 10 and exits the compressor through discharge pipe 112.

In this embodiment, check valve 10 is located at the discharge port 14 to prevent back-flow. Conventional configurations that employ a check-valve at the discharge pipe 112 rather than the discharge port 14 are prone to damage. For example, when the compressor is turned off, pressure may build up in the high discharge pressure region 111 causing fluid to flow back through the discharge port and into the interior space 20. This back-flow may cause reverse rotation of the scroll plates. Because the plates are designed to rotate only in one direction, reverse rotation may cause severe wrap damage. Even if the wraps are not damaged by the reverse rotation, at the very least, reverse rotation is accompanied by an annoying noise, or may cause an undesirable reverse current through the motor 152.

Figure 8A:
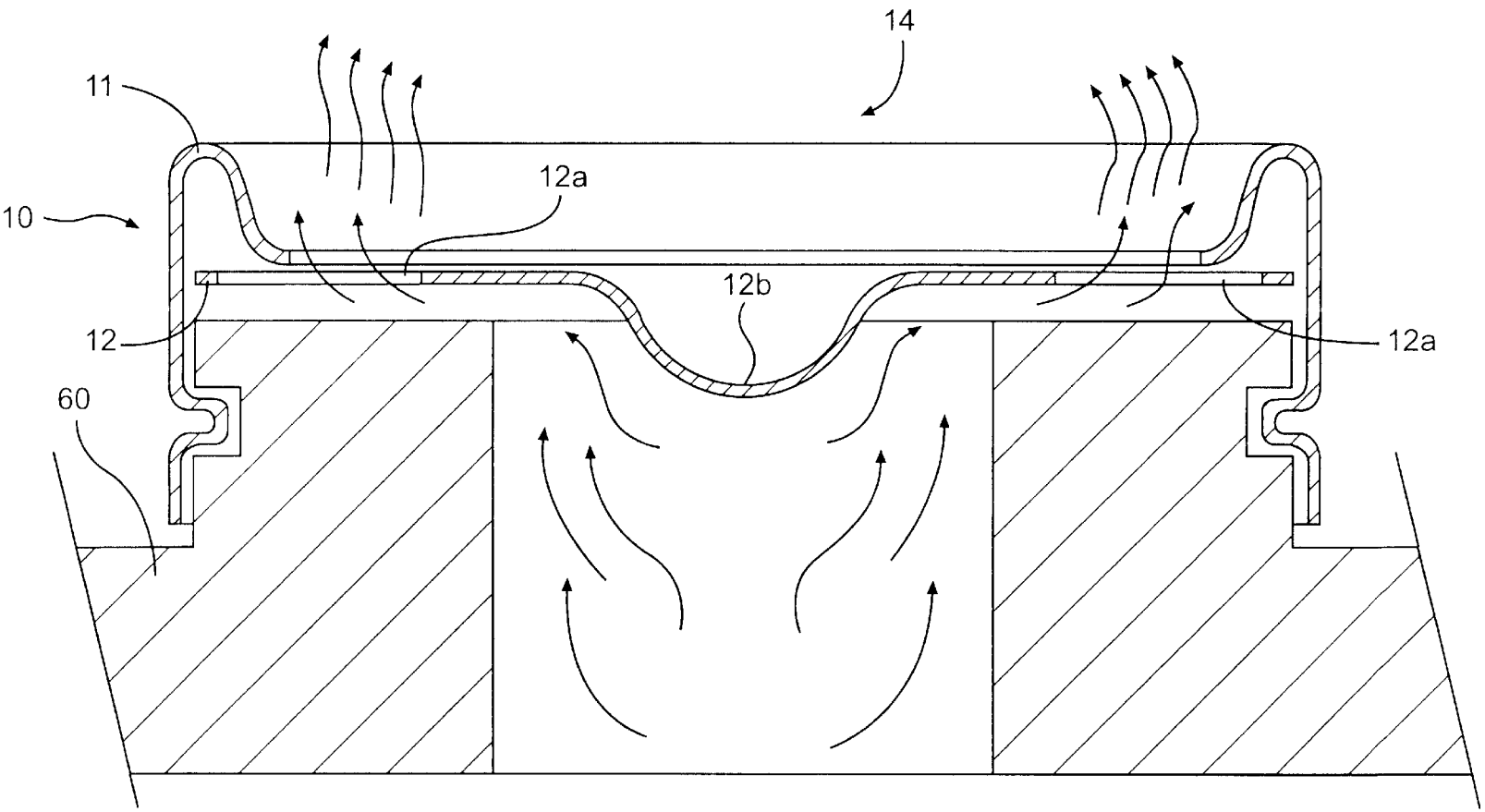
FIG. 8(A) is a diagram showing a check valve in a device according to the invention allowing out-flow of high-pressure fluid.

The check valve 10 shown in FIG. 3 comprises a plate 12 having a concave portion 12*b* (See FIGS. 8(A)&(B)) and multiple discharge holes 12*a* formed through the plate and around the concave portion 12*b*. FIG. 8(A) illustrates the operation of the check valve 10 as high pressure fluid exits the discharge port 14 formed through pressure partition 60. The fluid pressure lifts the plate 12 off of the discharge port and allows fluid to escape through the holes 12*a*. The fluid is directed towards the holes 12*a* by the concave portion 12*b*. Frame 11 prevents plate 12 from moving too far away from the discharge port 14 and has a large center hole that allows the fluid to escape into the high discharge pressure region 111 and out of the discharge pipe 112.

Figure 8B:
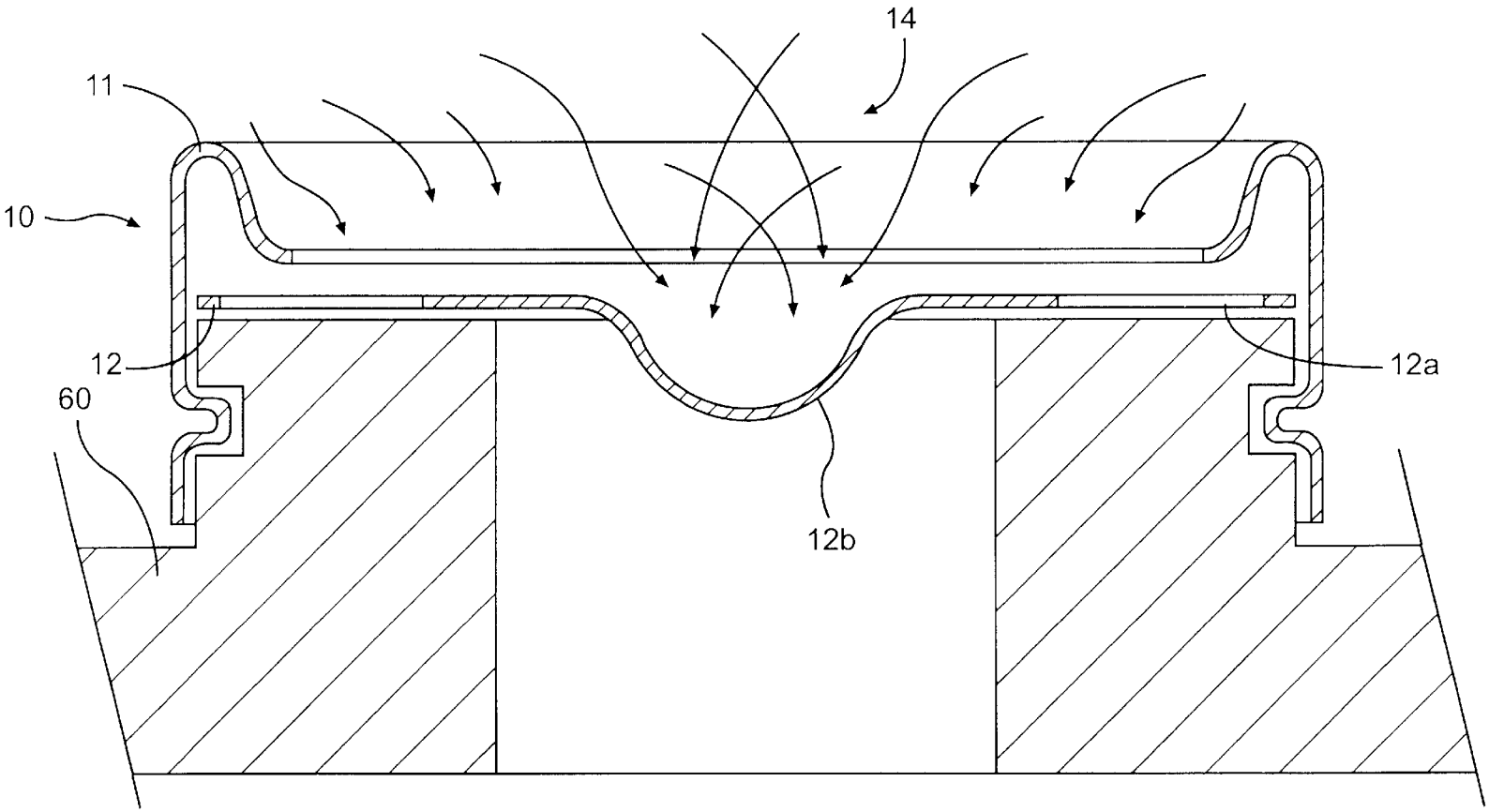
FIG. 8(B) is a diagram showing the check valve preventing back-flow through the compressor.
Figure 9:
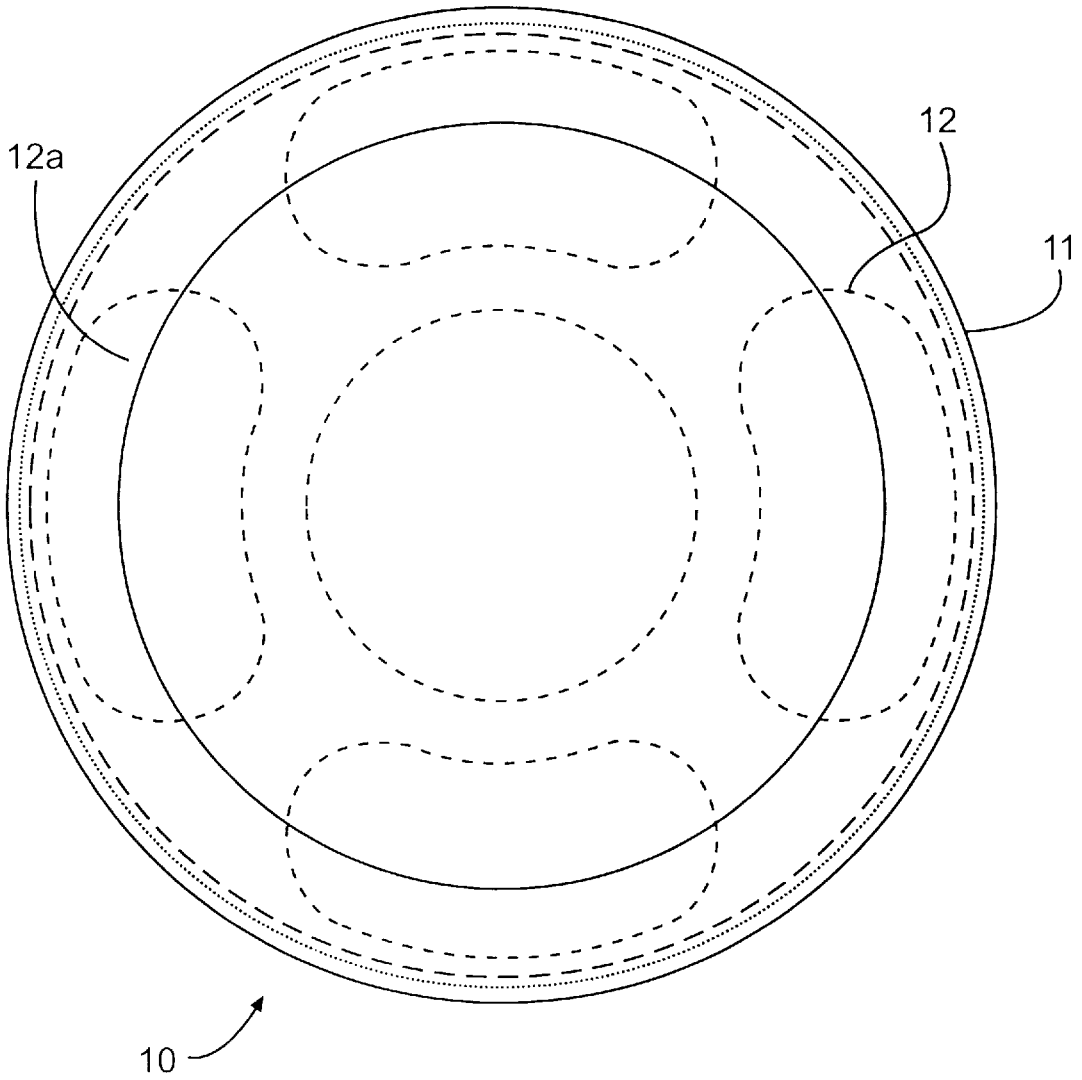
FIG. 9 is a horizontal sectional view of the check valve of FIGS. 8(A)&(B).

As illustrated in FIG. 8(B), the plate 12 seats itself back onto the discharge port when the high-pressure discharge is discontinued, e.g., when the compressor is shut off. This seating action can result from gravity and/or by the back-flow pressure of the fluid in the high pressure discharge region 111. The plate thus prevents back-flow into the interior space 20.

Figure 11:
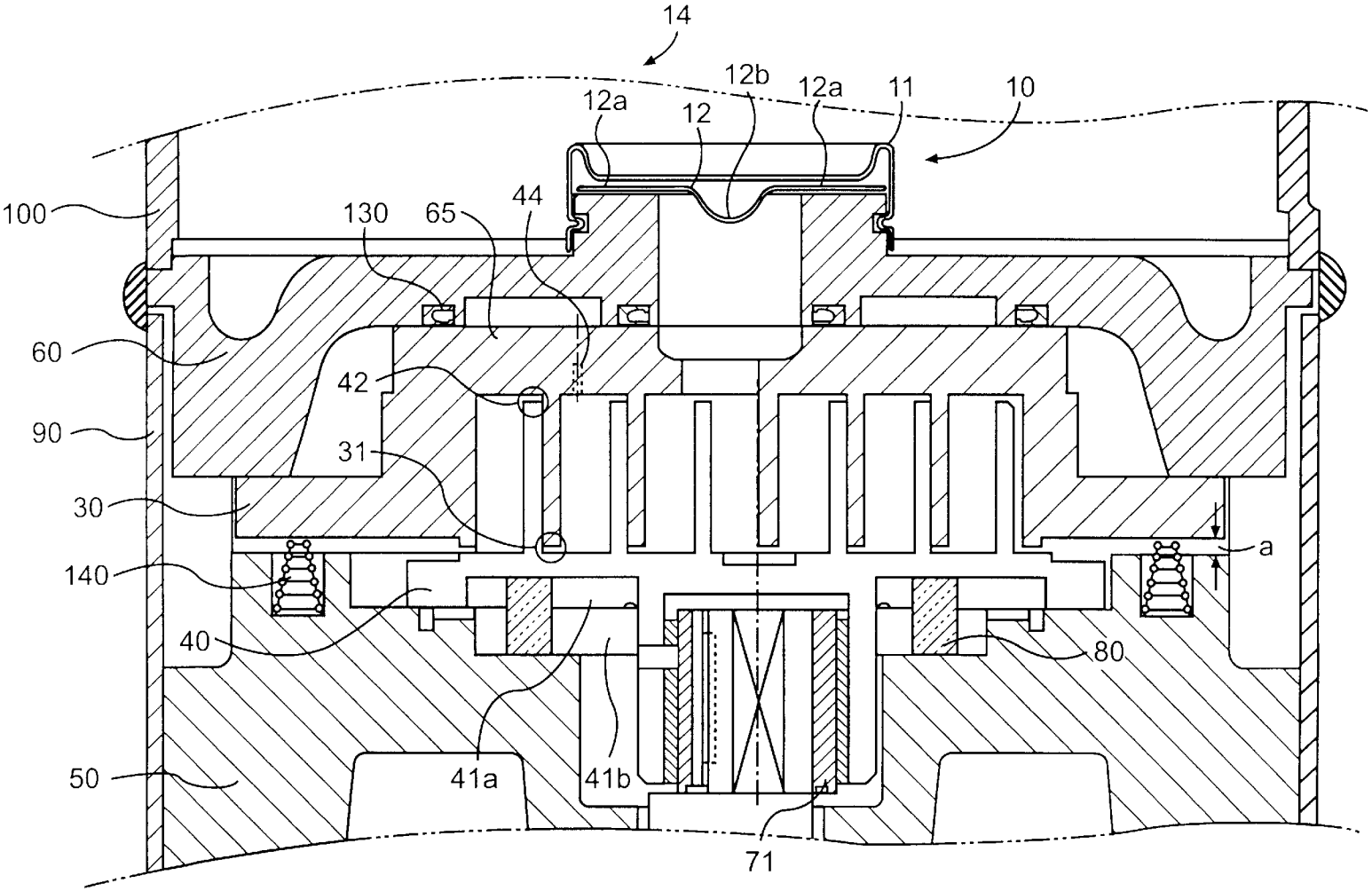
FIG. 11 is a view of another scroll plate configuration at rest.

A pressure equalizing passage 44 is formed in the non-orbiting scroll plate 30 to interconnect a back pressure pocket 65 and the interior space 20. The back pressure pocket 65 is located between the non-orbiting scroll plate 30 and the pressure partition 60 so that the non-orbiting scroll plate can be axially displaced towards and away from the upper frame 50 and the orbiting scroll plate 40. In FIG. 3, the back pressure pocket 65 is a ring-shaped recess in the non-orbiting scroll plate 30, and in FIG. 11 the back pressure pocket 65 is a ring shaped recess in the pressure partition 60. A particular pressure equalizing passage configuration is disclosed in pending U.S. patent application of Wan Pyo Park et al., Ser. No. 08/751,018 filed Nov. 15, 1996, attorney ref, No. 6330.0006, entitled "Scroll-Type Compressor Having Improved Pressure Equalizing Passage Configuration" expressly incorporated herein by reference in its entirety.

A seal 130 is located at the interface between the back pressure pocket 65 and the pressure partition 60 so as to prevent the pressurized fluid in the back pressure pocket from escaping out into the region of low suction pressure. A similar seal is located between the back pressure pocket 65 and the discharge port 14 to prevent the higher pressure fluid in the discharge port 14 from entering into the back pressure pocket 65. As the non-orbiting scroll plate moves towards the pressure partition, these seals are compressed in the axial direction. The seals are configured so that they maintain the integrity of the seals between the regions of different pressure even when the non-orbiting scroll is at its maximum displacement away from the pressure partition.

These seals 130 are much more easily installed than conventional seals. The seal 130 can simply be axially inserted into the groove in the non-orbiting scroll or in the pressure partition—a significantly simpler arrangement than the radial installation required for conventional radial seals. As will be explained below, one can appreciate that the entire compressor can be progressively assembled with each major component axially positioned into its appropriate location.

This advantageously quick and easy assembly configuration is further enabled by the lower assembly of the compressor. A lower frame 120 is located in the lower chamber 110, and preferably is spaced from the upper frame 50. A flange 150 maybe located between the upper frame 50 and the motor 152 to hold the motor 152 in place. This arrangement permits different sized motors to be used by requiring that only the flange 150, as opposed to the entire upper frame, needs to be custom fitted to the motor. It is less expensive to fabricate the flange 150 than the upper frame 50 which also must be fabricated to accommodate the specific scroll plate arrangement and other important components. The upper frame 50, the flange 150, and the lower frame 120 are preferably bolted together with long, axially extending, and axially inserted bolts 153. The bolts help to reduce vibration and noise. The flange 150 may also be welded to the intermediate chamber 90.

Figure 6A:
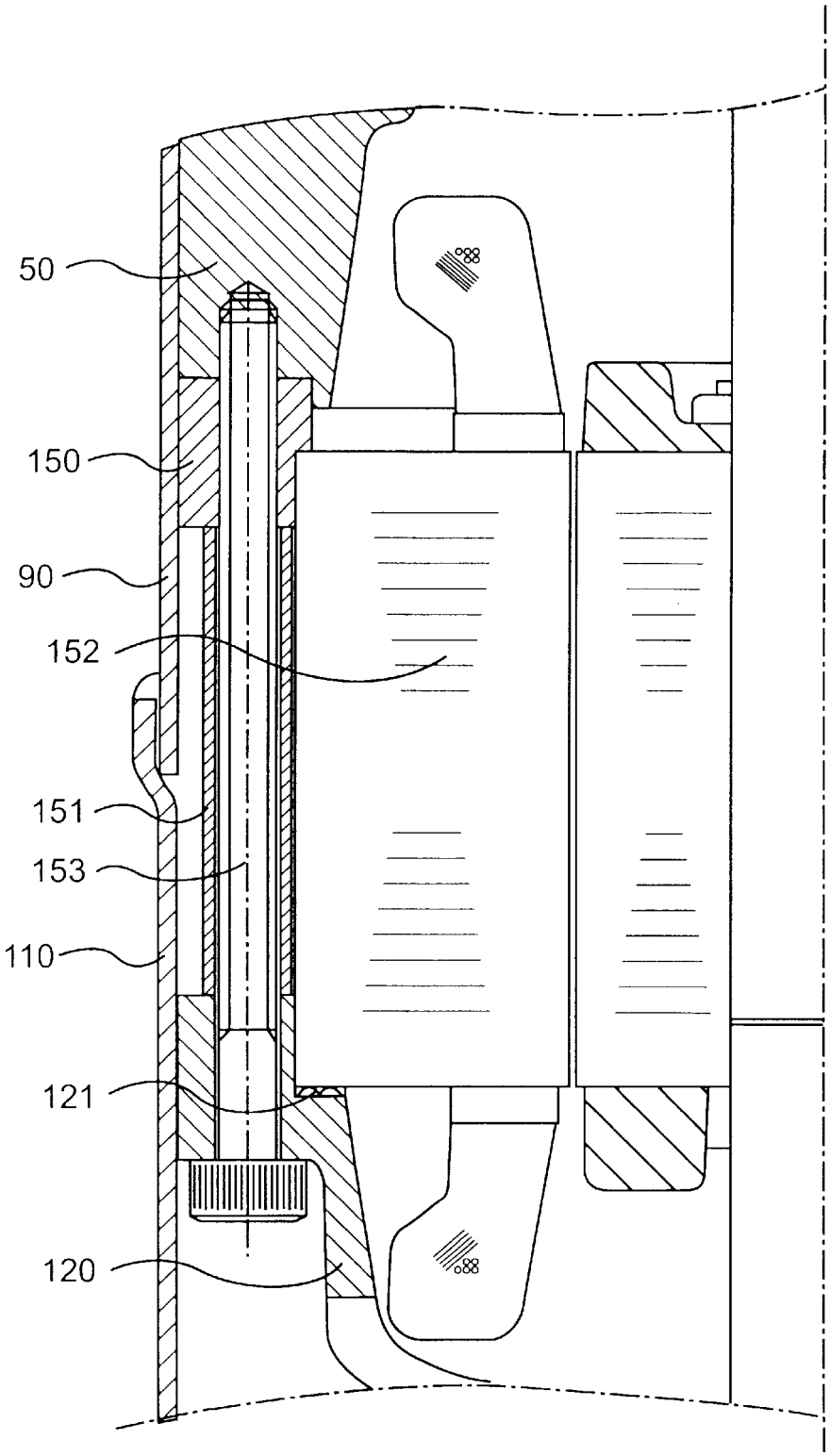
FIG. 6(A) is a view showing an assembly configuration according to an embodiment of the present invention.
Figure 6B:
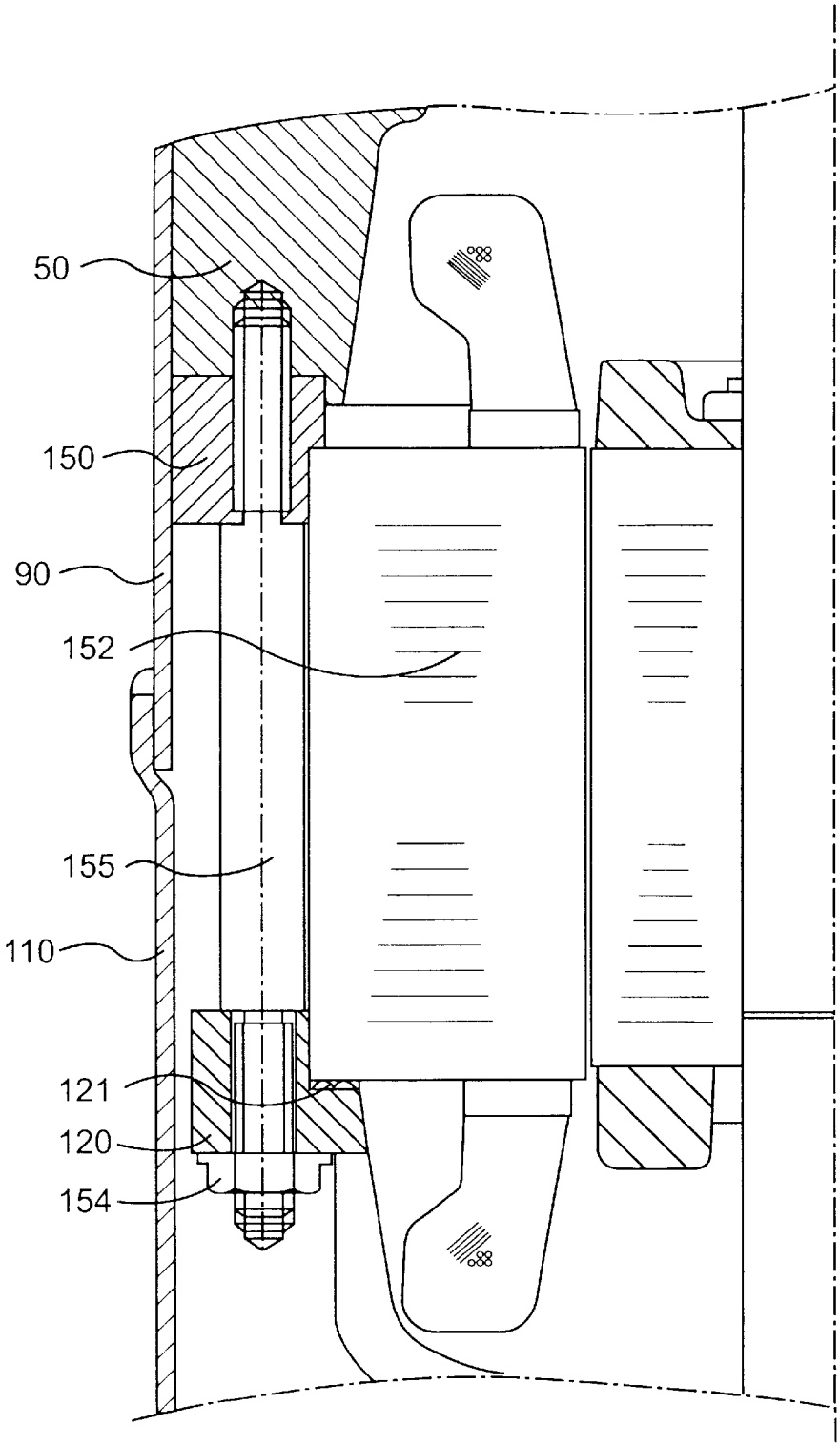
FIG. 6(B) is a view showing a second assembly configuration according to another embodiment of the present invention.

The spacing of the frames can be facilitated by a distance setting sleeve 151 (See FIG. 6(A), or a spacer bolt 155 (See FIG. 6(B) located between the upper and lower frames. The sleeve and the spacer bolt are preferred because they can be fabricated to predetermined lengths and provide a precise distance when they are bolted into place. This eliminates the need for the assembly line worker to waste time accurately inserting the bolt to precise tolerances, thereby also reducing the danger of misaligning the components of the compressor. This arrangement also obviates the need for highly accurate, complex and expensive automated assembly machines which might otherwise be used for the precise component assembly.

A spring may be used to absorb vibrations and starting torque forces. For example, a wave spring 121 may be located between motor 152 and lower frame 120.

Figure 4:
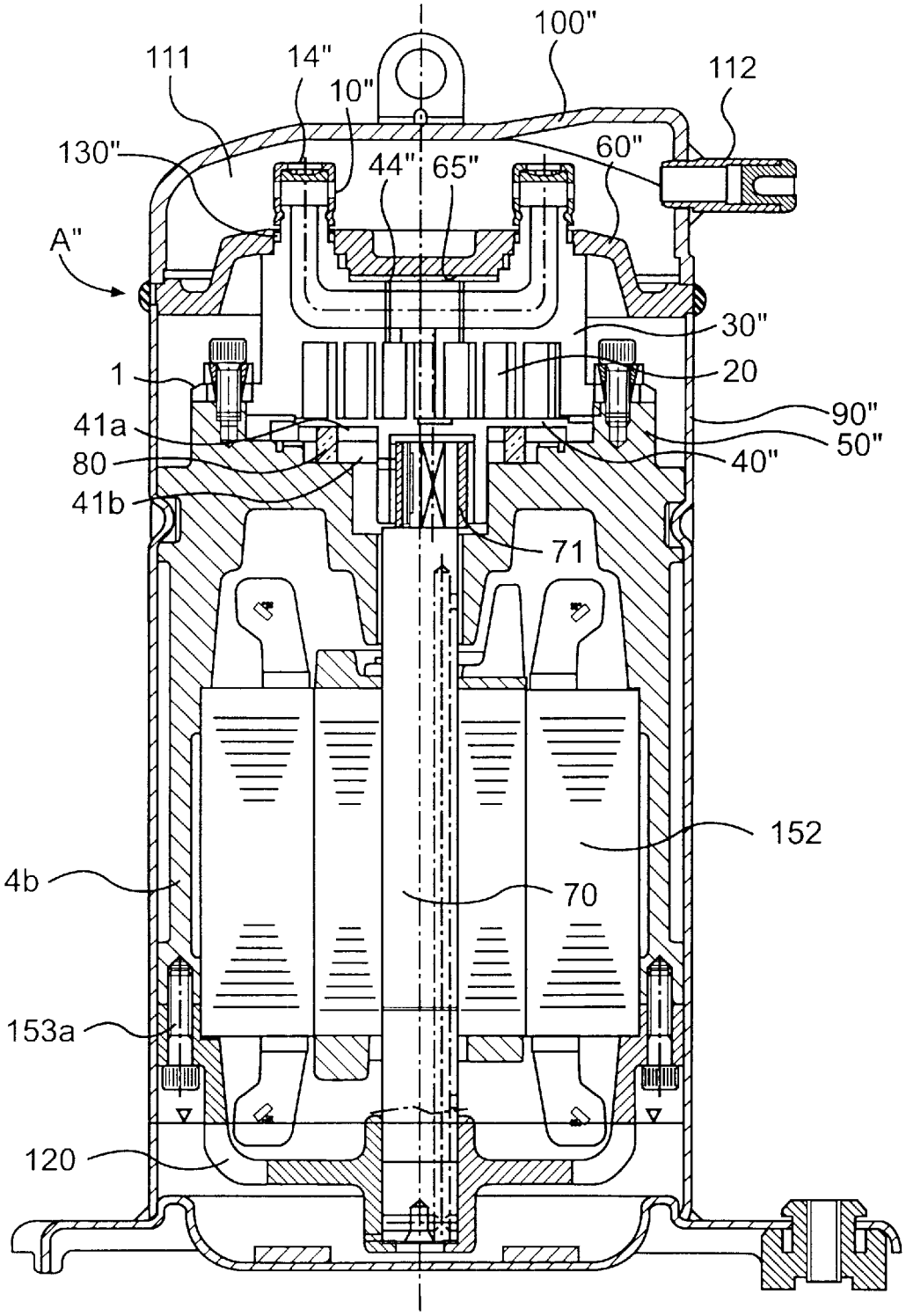
FIG. 4 illustrates a scroll-type compressor according to another embodiment of the present invention.

FIG. 4 illustrates another embodiment that exhibits an improved axial assembly configuration. The non-orbiting scroll 30" is bolted to the upper frame 50". The stop bolt 1 permits axial displacement in response to the pressures acting on the non-orbiting scroll plate. Multiple discharge ports 14" each have check valves 10" attached thereto to prevent back-flow. Seals 130" are axially installed and compressed, but are situated in different locations due to the location of the back-pressure pocket 65" and the multiple discharge ports 14".

The lower structure of the compressor differs from that shown in FIG. 3 by the manner in which the upper and lower frames are attached. Instead of a spaced relationship, the frames are bolted 153*a* together at the end of a long side wall 4*b* of the upper frame. This embodiment can be axially assembled, but many of the components of FIG. 3 are preferred for various reasons. For example, the bolt/spacer relationship of the FIG. 3 embodiment obviates the need for the long side wall 4*b*. The long side wall complicates assembly and may be prone to casting defects that are commonly encountered in thin-walled cast components.

Figure 7:
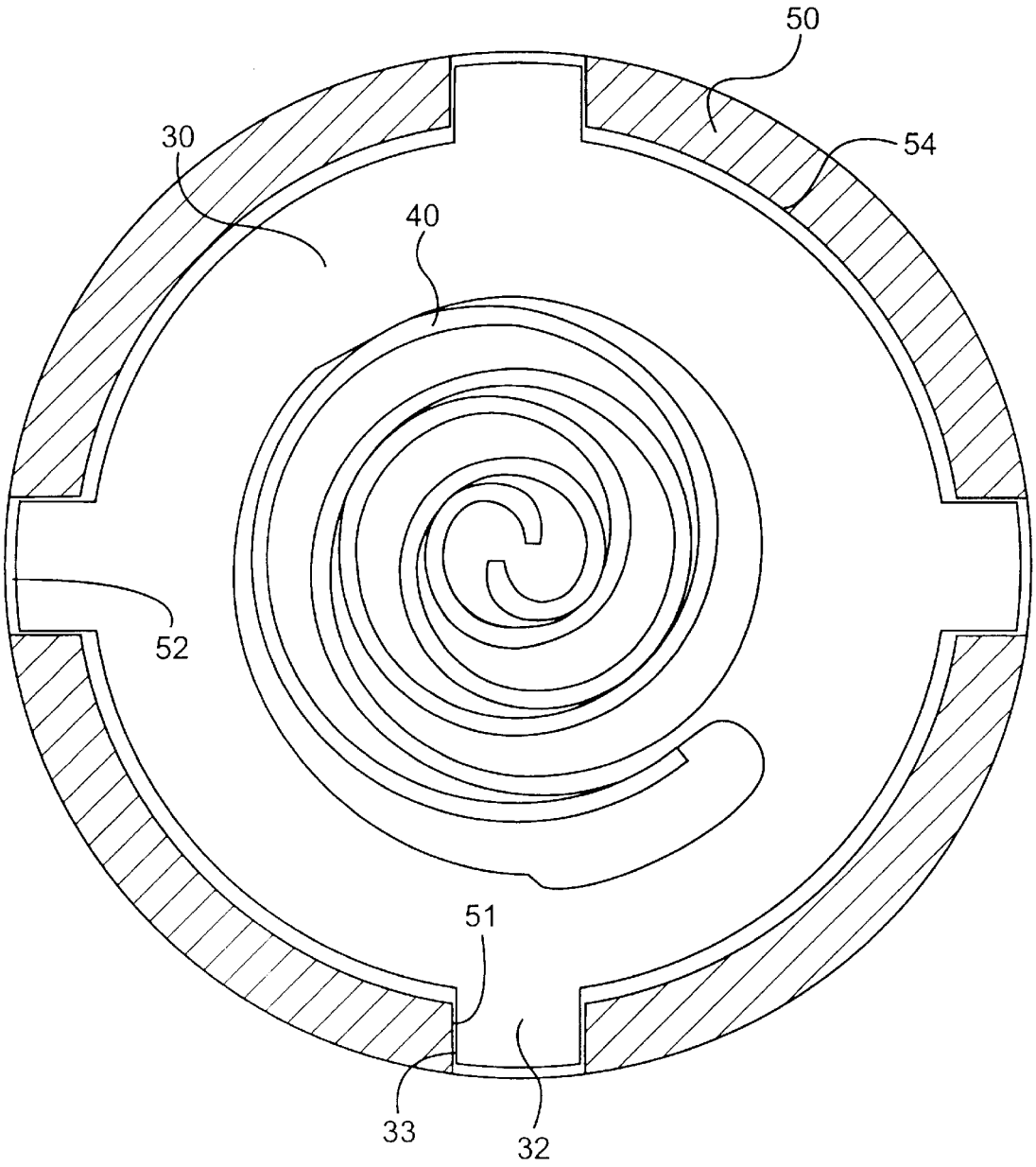
FIG. 7 is a view showing a key and key way assembly configuration according to another embodiment of the present invention.

The preferred scroll plate assembly is illustrated in FIG. 7. The upper frame 50 has a plurality of key ways 52 formed at equal spacings about the interior surface 54. The non-orbiting scroll plate 30 has a plurality of slide keys located at peripheral positions corresponding to the key ways. Each key 32 preferably has a height and width less than the depth and width of the corresponding key way. In this manner, the non-orbiting scroll plate can axially displace, the side walls 33 of the keys 32 sliding along the side walls 51 of the key ways 52, so that the compressor may operate more efficiently. The non-orbiting scroll plate may also move slightly in the radial direction or even slightly rotate to absorb forces in these directions and adjust in response to thermally induced stresses that may be created during the operation of the compressor. The extent of the displacement is determined by the respective sizes of the keys and key ways. For example, the desired value of axial displacement is equal to the difference between the depth of the key way 52 and the height of the key 32. This configuration allows assembly without bolts that may require low tolerances and complicate the assembly process.

Figure 5A:
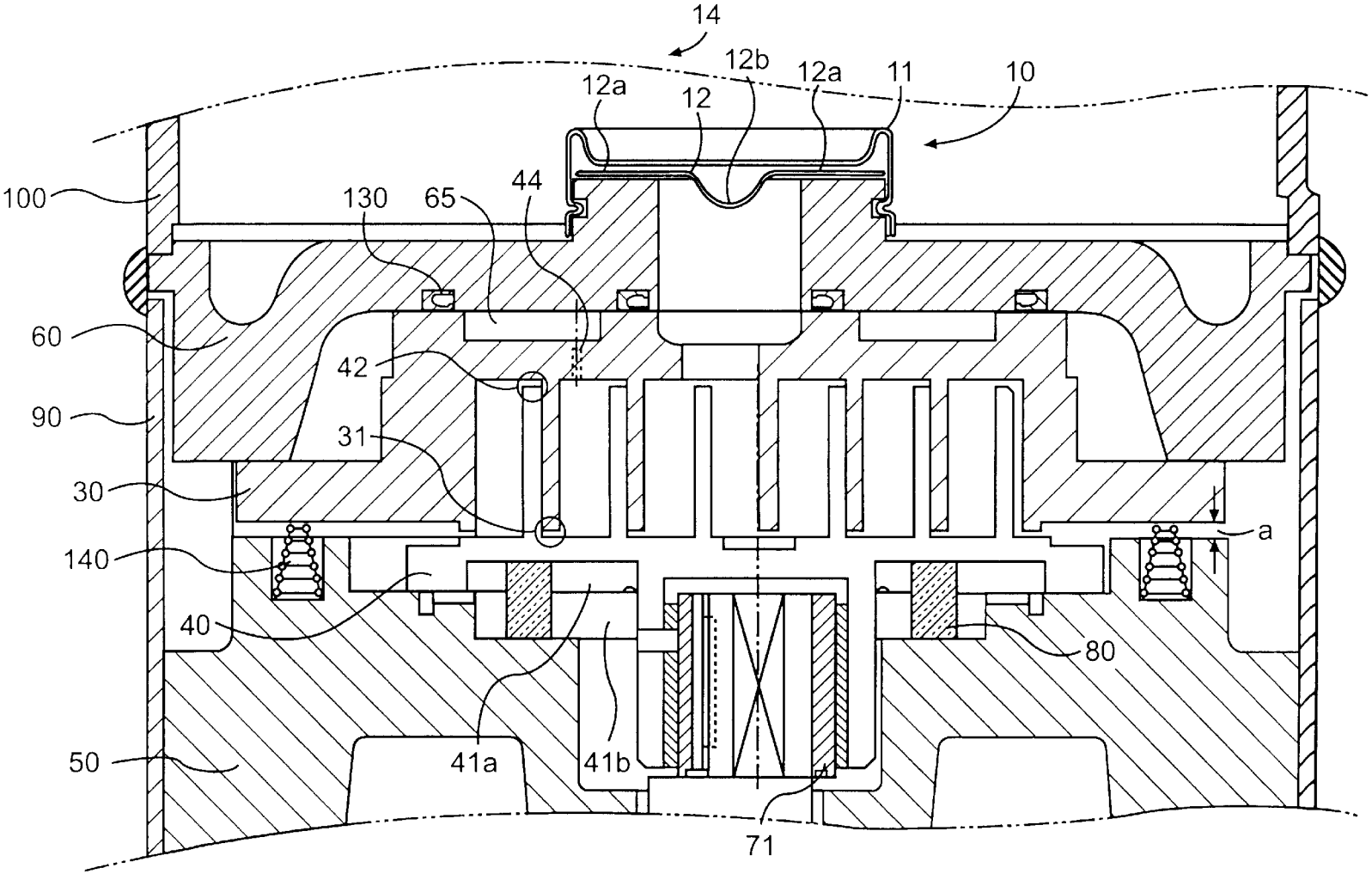
FIG. 5(A) is a view of a scroll plate configuration at rest.

Springs 140 axially bias the non-orbiting scroll plate 30 away from the upper frame 50. Preferably, the springs 140 are located in the key ways 52 and act on the keys. By axially biasing the non-orbiting scroll plate away from the frame and the orbiting scroll plate, the starting torque is reduced because static friction and inertia are reduced. FIG. 5(A) shows the compressor of the preferred embodiment at rest, prior to start-up. Springs 140 axially bias the non-orbiting scroll plate away from the upper frame by a distance, a. A space 42 is thereby created between the orbiting scroll wrap tip and the non-orbiting scroll plate—another space 31 exists between the non-orbiting scroll wrap tip and the orbiting scroll plate. The inventors have determined that, although these spaces sacrifice some efficiency at start-up, this loss is more than offset by the lower torque required to overcome friction and inertia at start-up.

An abutment member may be provided to prevent axial displacement of the non-orbiting scroll plate 30 greater than the desired value, a. Preferably, the abutment is provided by part of the pressure partition 60. For example, the portion of the pressure partition 60 adjacent to the back-pressure pocket 65 can be used to define a maximum displacement of the non-orbiting scroll 30. However, this portion is generally machined to a high tolerance to better maintain the integrity of the seals 130 preventing leaking between the regions of different pressures. If this portion of the pressure partition is used as an abutment member, the sealing surfaces may become scratched, dented, or chipped, potentially adversely affecting the integrity of the seals 130. Therefore, the preferred arrangement uses the peripheral portion of the pressure partition 60 to abut against the keys to prevent excessive axial displacement. This portion is not a sealing surface, and therefore mechanical wear and other damage is less likely to adversely affect the performance and service life of the compressor. Preferably, the displacement, a, is small enough so that seals 130 will always provide adequate sealing between the regions of different pressures, but large enough so that the metal surfaces of the non-orbiting scroll and the pressure partition do not contact.

While the springs 140 axially bias the non-orbiting scroll plate away from the orbiting scroll plate when the scroll plates are at rest relative to each other, starting the motor for the compressor causes the orbiting scroll plate to orbit relative to the other scroll plate, thereby radially moving crescent shaped pockets inwardly and reducing the volume of the crescent shaped pockets as they move towards a center point. By providing communication between the interior space 20 and the back pressure pocket 65 through a pressure equalizing passage 44, the pressure in the back pressure pocket increases as the plate orbits faster until the force of the pressure in the back pressure pocket 65 overcomes the force of the spring 140 and axially displaces the non-orbiting scroll plate 30 towards the upper frame 50 and the orbiting scroll plate 40.

Figure 5B:
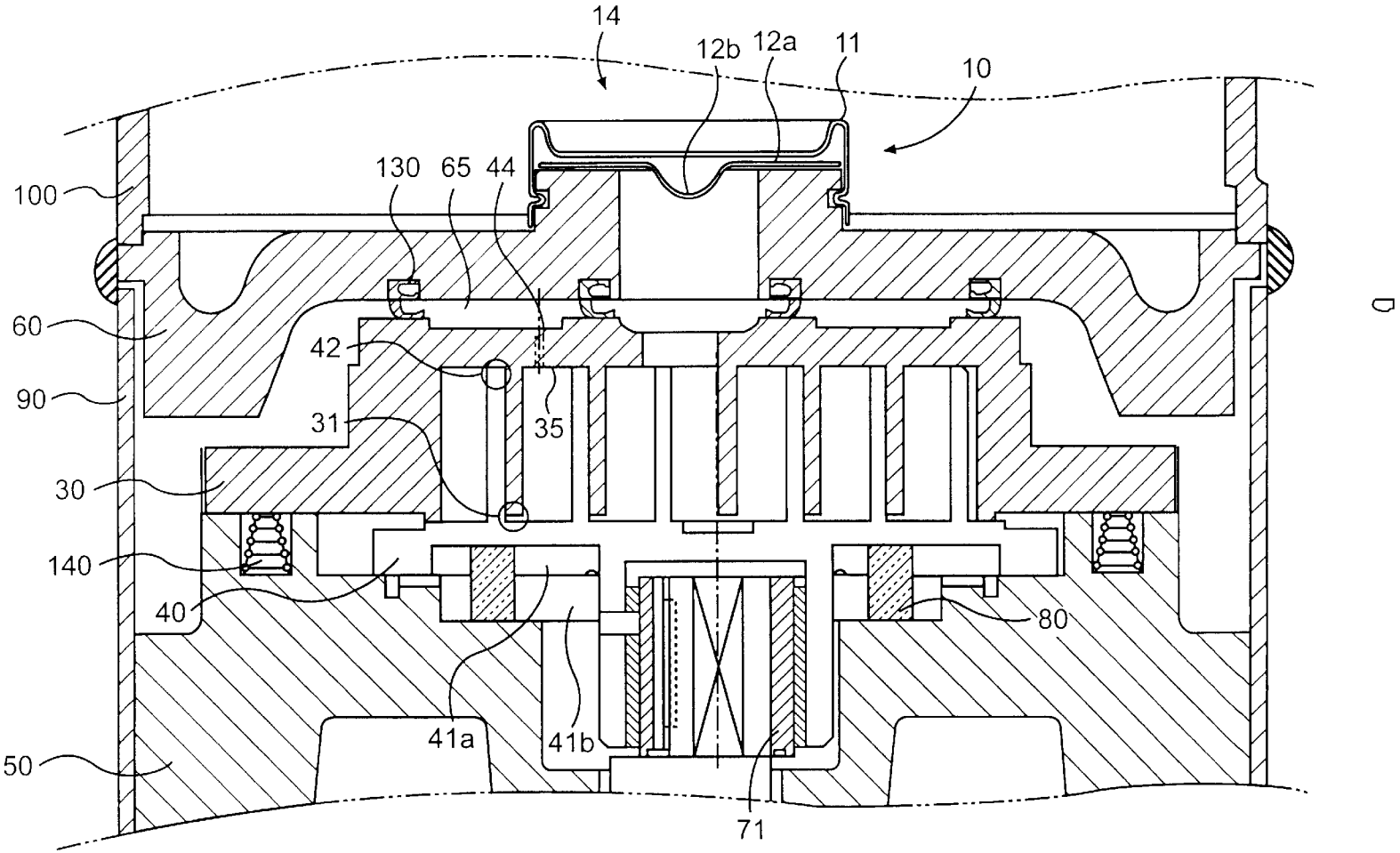
FIG. 5(B) is a view of a scroll plate configuration during a compression cycle.

FIG. 5(B) illustrates the scroll compressor during operation. Space 42 is eliminated and there now exists a seal preventing leakage past the wrap tips. Although in the embodiment illustrated in FIG. 5(B), there remains a space 31, this space can also be eliminated to provide a second seal to prevent leakage by lengthening the wrap of the non-orbiting scroll plate. During operation, unexpected pressure variations may be created in the crescent shaped pocket 65 or the back pressure pockets causing the non-orbiting scroll plate 30 to "jump." The abutment surface prevents the "jump" from exceeding a certain displacement and thereby prevents scratching or chipping of the sealing surfaces in the region of the seals 130.

Figure 10A:
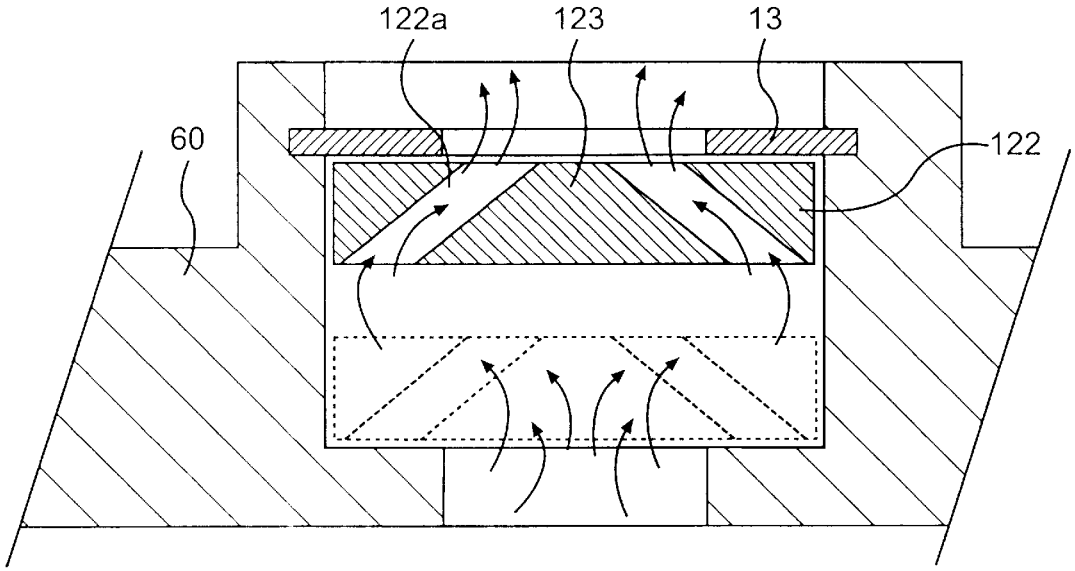
FIG. 10(A) is a diagram showing a second type of check valve in a device according to the invention allowing out-flow of high-pressure fluid.

FIGS. 10(A)&(B) illustrate a second type of check valve that includes a check valve body 122 having a cone-shaped central portion 123 and angled slots 122*a* extending through the check valve body adjacent to the cone-shaped central portion.

FIG. 10(A) illustrates the operation of the check valve 10 as high pressure fluid exits the discharge port 14 formed through pressure partition 60. The fluid pressure lifts the check valve body 122 off of the discharge port and allows fluid to escape through the slots 122*a*. Frame 13 prevents the body 122 from moving too far away from the discharge port 14 and has a large center hole that allows the fluid to escape into the high discharge pressure region 111, and, eventually, out of discharge pipe 112.

Figure 10B:
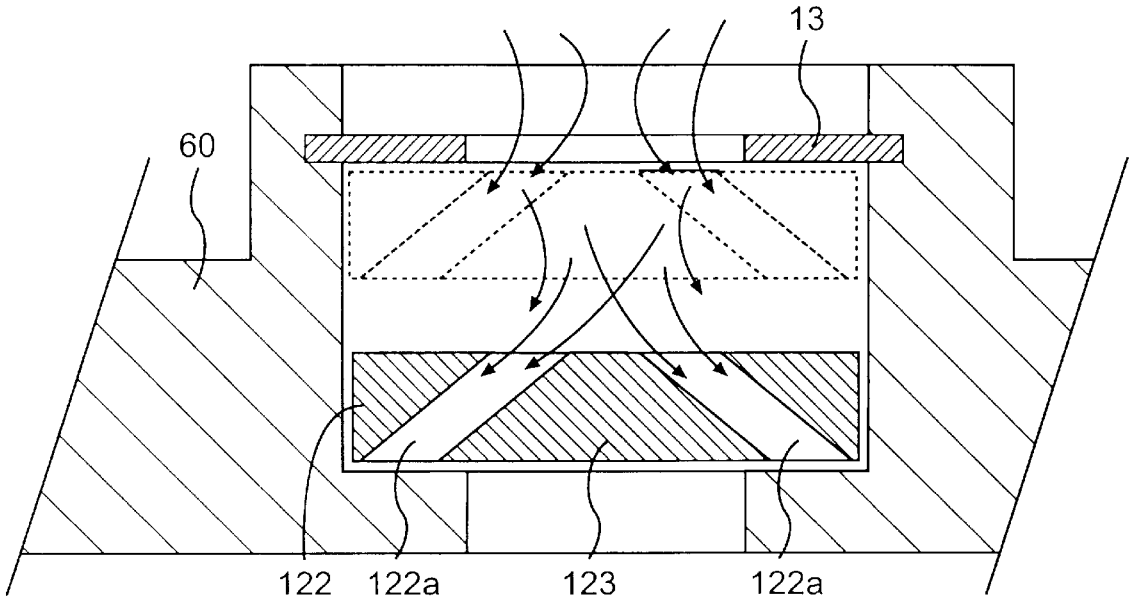
FIG. 10(B) is a diagram showing the second type of check valve preventing back-flow through the compressor.

As illustrated in FIG. 10(B), the cone-shaped central portion 123 of the body 122 seats itself back onto the discharge port when the high-pressure discharge is discontinued, e.g., when the compressor is shut off. This seating action can result from gravity and/or by the back-flow pressure of the fluid in the high pressure discharge region 111. The body 122 thus prevents the back-flow from entering the interior space 20 and causing reverse rotation of the scroll plates.

Figure 12:
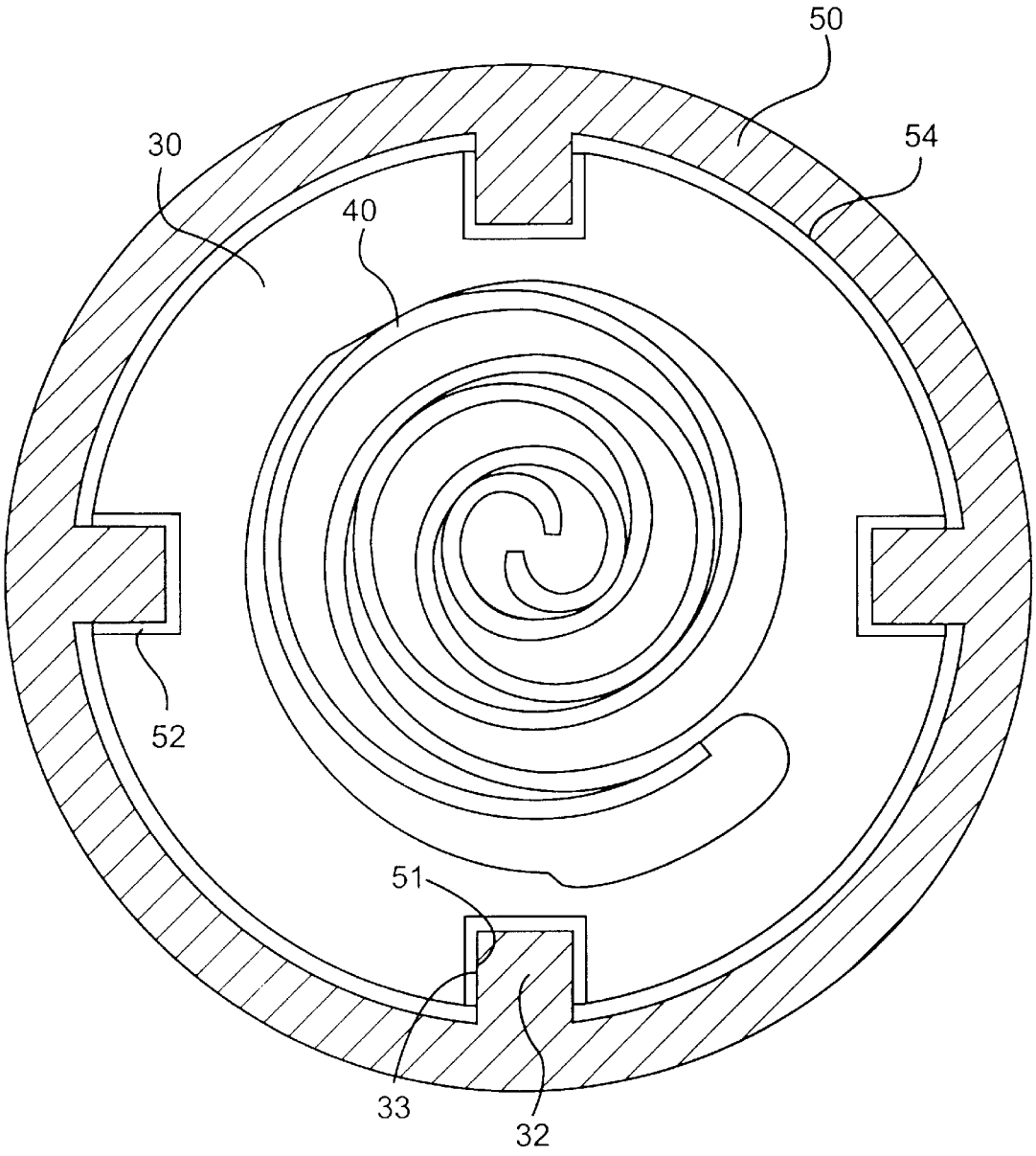
FIG. 12 is a view showing a key and key way assembly configuration according to another embodiment of the present invention.

It will be apparent to those skilled in the art that various modifications and variations can be made in the disclosed process and product without departing from the scope or spirit of the invention. For example, the key and key way configuration illustrated in FIG. 7 is only an example of an acceptable configuration. Another acceptable configuration is illustrated in FIG. 12, in which the key 32 extends from the frame 50 and the key way 52 is formed in the non-orbiting scroll plate 30. As used herein, the key/key way configuration can encompass any of a number of irregular shapes on the scroll plate that prevent unwanted radial and rotational displacement but permit axial displacement, while obviating the need for bolts or other rigid fasteners that render assembly more difficult. Other embodiments of the invention will be apparent to those skilled in the art from consideration of the specification and practice of the invention disclosed herein. It is intended that the specification and examples be considered as exemplary only.

As would be clear to those skilled in the art, the inventive compressor can be used to produce a relatively high pressure output and/or be used to produce a vacuum or other low pressure output, depending on whether the high or low pressure side of the compressor is connected to the relevant equipment. The term compressor as used herein includes, but is not limited to, scroll devices such as pumps, expanders, or engines.

What is claimed is:

1. A scroll-type fluid compressor, comprising a frame having an interior surface having at least one key way formed in said interior surface;

a non-orbiting scroll plate having an end plate on which a spiral shaped wrap is located, said non-orbiting scroll plate being retained in said frame and having a slide key extending radially into said key way;

an orbiting scroll plate having an end plate on which a spiral shaped wrap is located; said orbiting and non-orbiting scroll plates being arranged to interfit said spiral shaped wraps thereby defining an interior space comprising a series of movable, crescent shaped pockets which reduce in volume as they move radially inwardly towards a center point during an orbiting cycle in which the orbiting scroll plate orbits relative to the non-orbiting scroll plate; and springs axially biasing said non-orbiting scroll plate away from said frame.

2. The scroll-type fluid compressor of claim 1, including a pressure equalizing passage formed in said non-orbiting scroll plate, the pressure equalizing passage interconnecting a back pressure pocket and said interior space.

3. The scroll-type fluid compressor of claim 1, wherein said frame has a plurality of key ways formed at equal spacings about the interior surface; and said non-orbiting scroll plate has a plurality of slide keys located at peripheral positions corresponding to said plurality of key ways.

4. The scroll-type fluid compressor of claim 1, wherein said springs are located in said key ways.

5. The scroll-type fluid compressor of claim 1, including an abutment member being located adjacent to the key of said non-orbiting scroll plate and preventing axial displacement of the non-orbiting scroll plate greater than a desired value.

6. The scroll-type fluid compressor of claim 5, wherein the desired value of axial displacement is equal to the difference between the depth of the key way and the height of the key.

7. The scroll-type fluid compressor of claim 1, further comprising a check valve located at a discharge port of said non-orbiting scroll to prevent back-flow of fluid through the compressor.

8. The scroll-type fluid compressor of claim 7, wherein the check valve comprises a plate having a concave portion and multiple discharge holes formed through the plate and around said concave portion.

9. The scroll-type fluid compressor of claim 7, wherein the check valve comprises a check valve body having a cone-shaped central portion and angled slots adjacent to said cone-shaped central portion, said angled slots extending through the check valve body.

10. A scroll-type fluid compressor comprising a frame having an interior surface having at least one key way formed in said interior surface;

a non-orbiting scroll plate having an end plate on which a spiral shaped wrap is located, said non-orbiting scroll plate being retained in said frame and having a slide key interfitting with said key way;

an orbiting scroll plate having an end plate on which a spiral shaped wrap is located; said orbiting and non-orbiting scroll plates being arranged to interfit said spiral shaped wraps thereby defining an interior space comprising a series of movable, crescent shaped pockets which reduce in volume as they move radially inwardly towards a center point during an orbiting cycle in which the orbiting scroll plate orbits relative to the non-orbiting scroll plate;

a pressure partition separating a region of high discharge pressure from a region of low suction pressure; and a non-orbiting scroll plate abutment member being a part of said pressure partition and abutting against said at least one key to prevent axial displacement greater than a desired value.

11. The scroll-type fluid compressor of claim 10, including a pressure equalizing passage formed in said non-orbiting scroll plate, the pressure equalizing passage interconnecting a back pressure pocket and said interior space, said back pressure pocket being located between said non-orbiting scroll plate and said pressure partition.

12. The scroll-type fluid compressor of claim 11, wherein said back pressure pocket is a recess in said pressure partition.

13. The scroll-type fluid compressor of claim 12, wherein a seal is located at an interface between said back pressure pocket and said pressure partition, said seal being compressed in the axial direction.

14. The scroll-type fluid compressor of claim 11, wherein said back pressure pocket is a recess in said non-orbiting scroll plate.

15. The scroll-type fluid compressor of claim 14, wherein a seal is located at an interface between said back pressure pocket and said pressure partition, said seal being compressed in the axial direction.

16. A scroll-type fluid compressor, comprising a frame having an interior surface having at least one key;

a non-orbiting scroll plate having an end plate on which a spiral shaped wrap is located, said non-orbiting scroll plate being retained in said upper frame and having a key way, said key being interfitted with said key way;

an orbiting scroll plate having an end plate on which a spiral shaped wrap is located; said orbiting and non-orbiting scroll plates being arranged to interfit said spiral shaped wraps thereby defining an interior space comprising a series of movable, crescent shaped pockets which reduce in volume as they move radially inwardly towards a center point during an orbiting cycle in which the orbiting scroll plate orbits relative to the non-orbiting scroll plate; and a pressure partition separating a region of high discharge pressure from a region of low suction pressure, said pressure partition including a non-orbiting scroll plate abutment member to prevent axial displacement greater than a desired value.

17. A method of operating a scroll-type fluid compressor, comprising providing a pair of scroll plates, each having an end plate on which a spiral shaped wrap is located in an arrangement in which said spiral shaped wraps interfit to define an interior space comprising a series of movable, crescent shaped pockets which reduce in volume as they move radially inwardly towards a center point during an orbiting cycle in which one of the scroll plates orbits relative to the other scroll plate;

providing communication between said interior space and a back pressure pocket located adjacent to one of said scroll plates through a pressure equalizing passage formed through one of the end plates;

axially biasing one scroll plate away from the other scroll plate while the scroll plates are at rest relative to each other;

axially displacing said scroll plates towards each other by increasing the pressure in said back pressure pocket by rotating said orbiting scroll plate relative to the other scroll plate; and preventing rotation between one of said scroll plates and a stationary frame with a key and key way.

18. The method of operating a scroll-type fluid compressor of claim 17, including preventing excessive axial displacement of one scroll plate from the other scroll plate by providing an abutment member adjacent to one of said scroll plates.

* * * * *